US007871671B2

(12) United States Patent
Oguri et al.

(10) Patent No.: US 7,871,671 B2
(45) Date of Patent: Jan. 18, 2011

(54) PROCESS FOR PRODUCING METALLIC COMPONENT AND STRUCTURAL MEMBER

(75) Inventors: Kazuyuki Oguri, Nagoya (JP); Takahiro Sekigawa, Nagoya (JP); Akiko Inoue, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 12/225,799

(22) PCT Filed: Apr. 3, 2007

(86) PCT No.: PCT/JP2007/057425

§ 371 (c)(1),
(2), (4) Date: Dec. 3, 2008

(87) PCT Pub. No.: WO2007/116871

PCT Pub. Date: Oct. 18, 2007

(65) Prior Publication Data

US 2009/0092849 A1 Apr. 9, 2009

(30) Foreign Application Priority Data

Apr. 3, 2006 (JP) ..... 2006-102161

(51) Int. Cl.
*B05D 3/12* (2006.01)
*B21D 31/06* (2006.01)

(52) U.S. Cl. ..... 427/299; 72/53

(58) Field of Classification Search ..... 427/180, 427/299; 72/53
See application file for complete search history.

(56) References Cited

U.S. PATENT DOCUMENTS 3,073,022 A * 1/1963 Bush et al. ..... 72/53
4,552,784 A * 11/1985 Chu et al. ..... 427/192
6,938,448 B2 * 9/2005 Kennerknecht et al. ..... 72/53
2006/0219337 A1 * 10/2006 Suzuki et al. ..... 148/671

FOREIGN PATENT DOCUMENTS

| | | |
|---|---|---|
| JP | 10-166271 | 6/1998 |
| JP | 2002-301663 | 10/2002 |
| JP | 2006-22402 | 1/2006 |
| SU | 1266720 | 10/1986 |

OTHER PUBLICATIONS

International Search Report issued Jul. 17, 2007 in connection with PCT/JP2007/057425 corresponding to the present U.S. application.
Dörr, T. et al., *Influence of Shot Peening on Fatigue Performance of High-Strength Aluminum- and Magnesium Alloys, The 7th International Conference on Shot Peening*, Institute of Precision Mechanics (1999), pp. 153-160.
Kataoka, Y. et al., *Surface Modification of Aluminum Alloys by Micro Particles Peening and Coating, Aichi Industrial Technology Institute* (2002) w/ English concise explanation of relevance.
Russian Office Action issued on Nov. 17, 2009 in Russian patent application No. 2008142686, a foreign counterpart of the present application (and English description of relevant portions of Russian Office Action from Liapunov and Co.).

* cited by examiner

*Primary Examiner*—Frederick J Parker
(74) *Attorney, Agent, or Firm*—Wenderoth, Lind & Ponack, L.L.P.

(57) ABSTRACT

A process for producing a metallic component that includes shot peening the surface of a metallic material, wherein almost no dimensional change or roughening of the surface profile of the metallic material occurs, the iron fraction adhered to the surface of the metallic material is removed efficiently, and the fatigue properties of the produced metallic component are improved. First particles containing iron as the main component and having an average particle size of not less than 0.1 mm and not more than 5 mm are projected onto the surface of a metallic material containing a lightweight alloy, and second particles containing essentially no iron and having an average particle size of not more than 200 μm are then projected onto the surface of the metallic material.

3 Claims, 10 Drawing Sheets

| | |
|---|---|
| Surfcorder | SE-2300 |
| V. mag. | 2000 |
| H. mag. | 50 |
| Length | 2.0mm |
| Drive speed | 0.1mm/s |
| Cutoff | 0.8mm |
| | |
| Ra | 0.2 μm |
| RMS | 0.3 μm |
| Rt | 1.9 μm |
| Rmax | 2.7 μm |
| Rz | 2.0 μm |
| RmaxD | 1.6 μm |

| | |
|---|---|
| Surfcorder | SE-2300 |
| V. mag. | 2000 |
| H. mag. | 50 |
| Length | 2.0mm |
| Drive speed | 0.1mm/s |
| Cutoff | 0.8mm |
| Ra | 5.3 μm |
| RMS | 6.7 μm |
| Rt | 30.2 μm |
| Rmax | 34.1 μm |
| Rz | 22.6 μm |
| RmaxD | 22.4 μm |
| RzD | 19.4 μm |

| | |
|---|---|
| Surfcorder | SE-2300 |
| V. mag. | 2000 |
| H. mag. | 50 |
| Length | 2.0mm |
| Drive speed | 0.1mm/s |
| Cutoff | 0.8mm |
| Ra | 4.8 μm |
| RMS | 5.7 μm |
| Rt | 22.9 μm |
| Rmax | 37.0 μm |
| Rz | 18.7 μm |
| RmaxD | 22.9 μm |
| RzD | 15.6 μm |

| | |
|---|---|
| Surfcorder | SE-2300 |
| V. mag. | 2000 |
| H. mag. | 50 |
| Length | 2.0mm |
| Drive speed | 0.1mm/s |
| Cutoff | 0.8mm |
| Ra | 5.2 μm |
| RMS | 6.7 μm |
| Rt | 36.4 μm |
| Rmax | 39.6 μm |
| Rz | 27.2 μm |
| RmaxD | 29.8 μm |
| RzD | 23.3 μm |

| | |
|---|---|
| Surfcorder | SE-2300 |
| V. mag. | 5000 |
| H. mag. | 50 |
| Length | 2. 0mm |
| Drive speed | 0. 1mm/s |
| Cutoff | 0. 8mm |
| Ra | 0. 12 μm |
| RMS | 0. 16 μm |
| Rt | 0. 86 μm |
| Rmax | 2. 67 μm |
| Rz | 0. 89 μm |
| RmaxD | 0. 85 μm |
| RzD | 0. 64 μm |

| | |
|---|---|
| Surfcorder | SE-2300 |
| V. mag. | 5000 |
| H. mag. | 50 |
| Length | 2.0mm |
| Drive speed | 0.1mm/s |
| Cutoff | 0.8mm |
| Ra | 0.60 μm |
| RMS | 0.77 μm |
| Rt | 4.29 μm |
| Rmax | 6.14 μm |
| Rz | 4.66 μm |
| RmaxD | 4.29 μm |
| RzD | 3.39 μm |

| | |
|---|---|
| Surfcorder | SE-2300 |
| V. mag. | 5000 |
| H. mag. | 50 |
| Length | 2.0mm |
| Drive speed | 0.1mm/s |
| Cutoff | 0.8mm |
| Ra | 0.55 μm |
| RMS | 0.68 μm |
| Rt | 3.69 μm |
| Rmax | 5.26 μm |
| Rz | 4.06 μm |
| RmaxD | 3.52 μm |
| RzD | 3.00 μm |

| | |
|---|---|
| Surfcorder | SE-2300 |
| V. mag. | 5000 |
| H. mag. | 50 |
| Length | 2.0mm |
| Drive speed | 0.1mm/s |
| Cutoff | 0.8mm |
| Ra | 0.66 μm |
| RMS | 0.81 μm |
| Rt | 4.14 μm |
| Rmax | 5.05 μm |
| Rz | 4.26 μm |
| RmaxD | 4.03 μm |
| RzD | 3.51 μm |

PROCESS FOR PRODUCING METALLIC COMPONENT AND STRUCTURAL MEMBER

TECHNICAL FIELD

The present invention relates to a process for producing a metallic component having improved fatigue properties and a structural member.

BACKGROUND ART

Shot peening represents a known example of a surface modification process that is used for enhancing the fatigue strength of metallic materials such as the structural members used in aircraft and automobiles and the like. Shot peening is a method in which, by blasting countless particles having a particle size of approximately 0.8 mm (the shot material) together with a stream of compressed air onto the surface of a metallic material, the hardness of the metallic material surface is increased, and a layer having compressive residual stress is formed at a certain depth.

Particles composed of an iron-based material such as cast steel are cheap, and unlike sharp materials such as glass are unlikely to damage metallic material surfaces even when crushed, and they are therefore widely used as shot materials.

In terms of improving the fatigue strength of aluminum materials by shot peening, the process mentioned below has been disclosed (see Non Patent Citation 1).

Non Patent Citation 1: T. Dorr and four others, "Influence of Shot Penning on Fatigue Performance of High-Strength Aluminum and Magnesium Alloys", The 7th International Conference on Shot Peening, 1999, Institute of Precision Mechanics, Warsaw, Poland. Internet <URL: http://www-.shotpeening.org/ICSP/icsp-7-20.pdf>

SUMMARY OF INVENTION

When shot peening using a shot material composed of an iron-based material, a portion of the shot material remains on the surface of the metallic material that has been shot peened. Because the iron fraction within the shot material that is retained on the surface of the metallic material in this manner can cause corrosion, an iron fraction removal treatment that removes the iron fraction of the shot material adhered to the metallic material surface must be performed following completion of shot peening in order to prevent this type of corrosion.

A process in which the shot peened metallic material is immersed in a solvent that dissolves iron (namely, a wet process) has typically been employed as this type of iron fraction removal treatment. However, with a wet process, efficiently removing only the iron fraction is difficult. Furthermore, if an attempt is made to completely remove the iron fraction using a wet process, then several μm of the metallic material is also dissolved at the material surface, which causes problems such as changes in the material dimensions and roughening of the surface profile.

The present invention has been developed in light of these circumstances, and has an object of providing a process for producing a metallic component of a structural member or the like used in an aircraft or automobile or the like, the process comprising shot peening the surface of a metallic material, wherein almost no dimensional change or roughening of the surface profile of the metallic material occurs, the iron fraction adhered to the surface of the metallic material is removed efficiently, and the fatigue properties of the produced metallic component are further improved.

In order to achieve the object described above, the present invention adopts the aspects described below.

Namely, a process for producing a metallic component according to the present invention comprises a first projection step of projecting first particles comprising iron as the main component and having an average particle size of not less than 0.1 mm and not more than 5 mm onto the surface of a metallic material comprising a lightweight alloy, and following completion of the first projection step, a second projection step of projecting second particles comprising essentially no iron and having an average particle size of not more than 200 μm onto the surface of the metallic material.

In the present invention, the "average particle size" is determined as the particle size corresponding with the peak in a frequency distribution curve, and is also referred to as the most frequent particle size or the modal diameter. Alternatively, the average particle size may also be determined using the methods listed below.

(1) A method in which the average particle size is determined from a sieve curve (the particle size corresponding with R=50% is deemed the median diameter or 50% particle size, and is represented using the symbol $d_{p50}$).

(2) A method in which the average particle size is determined from a Rosin-Rammler distribution.

(3) Other methods (such as determining the number average particle size, length average particle size, area average particle size, volume average particle size, average surface area particle size, or average volume particle size).

According to this process, in the production of a metallic component, the effect of fatigue improvement by conventional shot peening is retained, and dimensional changes and surface roughening of the metallic material caused by removal of the iron fraction can be prevented.

Furthermore, a structural member of the present invention includes a metallic component produced using the production process described above.

A structural member of the present invention has excellent fatigue properties, and suffers no dimensional changes or surface roughening of the metallic material caused by removal of the iron fraction. This structural member can be used favorably in the field of transportation machinery such as aircraft and automobiles, and in other fields that require favorable material fatigue properties.

The present invention provides a process for producing a metallic component of a structural member or the like used in an aircraft or automobile or the like, the process comprising shot peening the surface of a metallic material, wherein the effect of fatigue improvement by conventional shot peening using an iron-based shot material is retained, and dry removal of the iron fraction is possible, meaning the operating costs can be reduced dramatically. Moreover, dimensional changes or surface roughening of the metallic material caused by the removal of the iron fraction are almost nonexistent, ensuring a surface profile of uniform quality, and because a high compressive residual stress can be generated at the outermost surface using a microparticle shot, fatigue improvement that is greater than that obtainable using conventional shot peening can be expected.

DETAILED DESCRIPTION OF THE INVENTION

Figure 1:
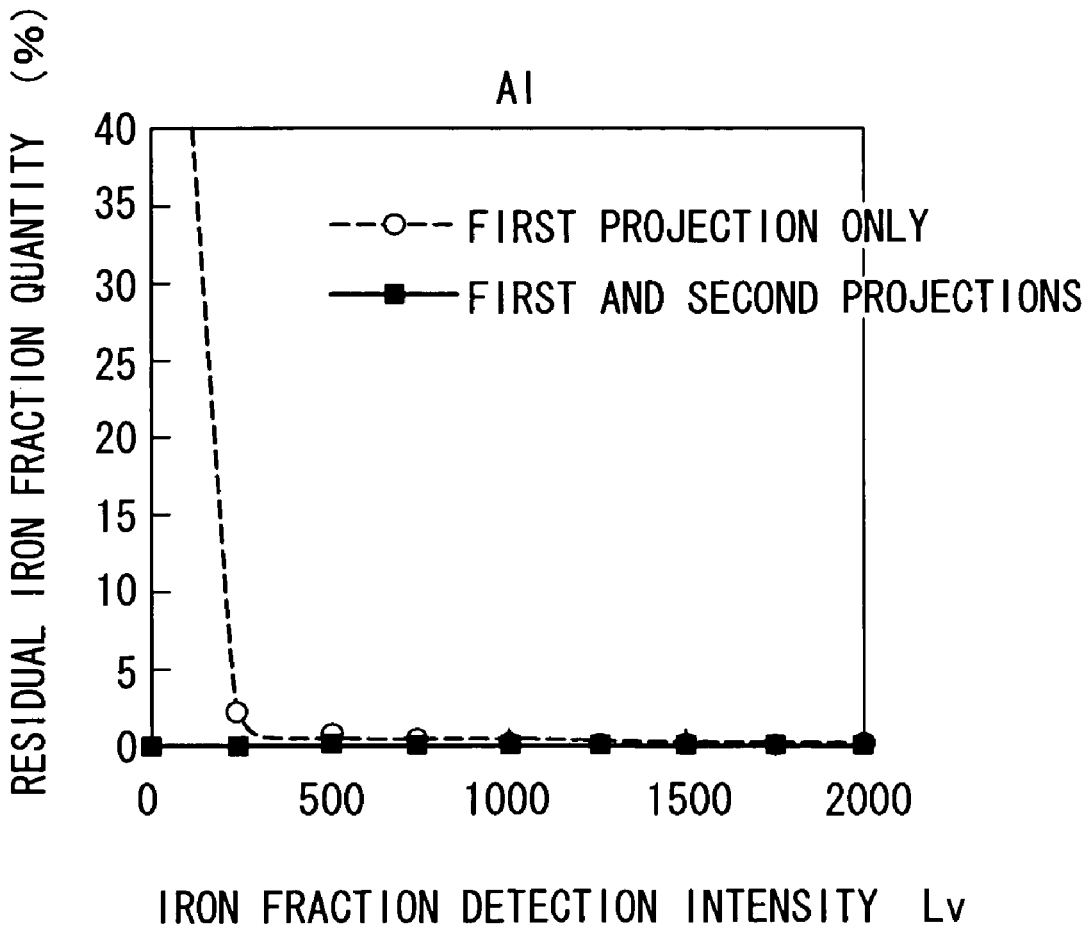
[FIG. 1] A diagram showing a concentration distribution for the residual iron fraction at the treated surface of a test specimen composed of an aluminum alloy material following shot peening the specimen.

A description of embodiments of the process for producing a metallic component according to the present invention is presented below, with reference to the drawings.

In the process for producing a metallic component according to the present invention, a lightweight alloy is used as the metallic material that acts as the substrate. Examples of the lightweight alloy used for the metallic material include aluminum alloys and titanium alloys.

In the process for producing a metallic component according to the present invention, examples of the first particles (the first shot material) comprising iron as the main component include cast steel and round cut wire and the like. Furthermore, examples of the second particles (the second shot material) comprising essentially no iron include hard particles of a metal, ceramic or glass or the like, and of these, ceramic particles such as alumina or silica particles are preferred.

The average particle size of the first shot material is not less than 0.1 mm and not more than 5 mm, and is preferably not less than 0.2 mm and not more than 2 mm. If the average particle size of the first shot material is smaller than 0.1 mm, then the compressive residual stress decreases, and the effect of shot peening diminishes, both of which are undesirable. Furthermore, if the average particle size of the first shot material is greater than 5 mm, then the surface roughness increases and surface damage becomes more likely, thereby diminishing the effect of shot peening and increasing the degree of deformation.

The average particle size of the second shot material is not more than 200 μm, and is preferably not less than 10 μm and not more than 100 μm. If the average particle size of the second shot material is greater than 200 μm, then the effect of the microparticle shot peening is reduced, which is undesirable. Furthermore, if the average particle size of the second shot material is smaller than 10 μm, then achieving a stable spray state becomes difficult, and a satisfactory iron fraction removal effect cannot be expected.

The spray speed of the shot material is regulated by the spray pressure of the compressed air stream. The spray pressure in the first projection step (the first shot peening) of the present invention is preferably not less than 0.1 MPa and not more than 1 MPa, and is even more preferably not less than 0.2 MPa and not more than 0.5 MPa. If the spray pressure is greater than 1 MPa, then the excessively large kinetic energy of the particles may damage the material surface, meaning a satisfactory improvement in the fatigue life cannot be achieved. Furthermore, if the spray pressure is less than 0.1 MPa, then achieving a stable spray state becomes very difficult.

The spray speed of the shot material is regulated by the spray pressure of the compressed air stream. The spray pressure in the second projection step (the second shot peening) of the present invention is preferably not less than 0.1 MPa and not more than 1 MPa, and is even more preferably not less than 0.3 MPa and not more than 0.6 MPa. If the spray pressure is greater than 1 MPa, then the excessively large kinetic energy of the particles may damage the material surface, meaning a satisfactory improvement in the fatigue life cannot be achieved. Furthermore, if the spray pressure is less than 0.1 MPa, then achieving a stable spray state becomes very difficult. In the first projection step (the first shot peening) of the present invention, in addition to nozzle type shot peening devices, impeller type shot peening devices may also be used. In such cases, the shot peening conditions can be adjusted by altering the rate of revolution of the impeller.

A preferred condition for the first shot peening, expressed in terms of the arc height value (the intensity) determined using an Almen gauge system, which defines the shot peening intensity, is preferably not less than 0.10 mmA and not more than 0.30 mmA, regardless of whether a nozzle-type spray system or an impeller-type system is used.

The shot material particles for both the first shot material and the second shot material are preferably a spherical shape with smooth surfaces. The reason for this preference is that if the shot material particles are sharp, then the surface of the metallic component may become damaged.

The coverage of the first shot peening is preferably not less than 100% and not more than 1,000%, and is even more preferably not less than 100% and not more than 500%. At coverage levels less than 100%, regions that have not been shot remain, meaning a satisfactory improvement in the fatigue strength cannot be obtained. Furthermore, if the coverage level exceeds 1,000%, then the roughness of the material surface increases, and an increase in temperature at the material surface causes a reduction in the compressive residual stress at the outermost surface, meaning a satisfactory improvement in fatigue strength cannot be obtained.

The coverage of the second shot peening is preferably not less than 100% and not more than 1,000%, and is even more preferably not less than 100% and not more than 500%. At coverage levels less than 100%, neither a satisfactory iron fraction removal effect, nor a satisfactory improvement in the fatigue strength can be obtained. Furthermore, if the coverage level exceeds 1,000%, then an increase in temperature at the material surface causes a reduction in the compressive residual stress at the outermost surface, meaning a satisfactory improvement in fatigue strength cannot be obtained.

A metallic component that has been shot peened under the conditions described above preferably exhibits the surface properties (surface compressive residual stress and surface roughness) described below.

[Surface Compressive Residual Stress]

In a metallic component that has undergone first shot peening and second shot peening in accordance with the present invention, a high compressive residual stress of not less than 150 MPa exists either at the outermost surface of the material, or within the vicinity thereof. As a result, the surface is strengthened and fatigue failure occurs not at the surface, but within the interior of the material, meaning the fatigue life increases significantly.

By performing first shot peening and second shot peening on the metallic material under the above conditions, a surface-treated metallic component of the present invention is obtained.

A more detailed description of the process for producing a metallic component according to the present invention is presented below using a series of examples and comparative examples.

Example 1

A sheet of an aluminum alloy material (7050-T7451, dimensions: 19 mm×76 mm×2.4 mm) was used as a test specimen. One surface of this specimen was subjected to first shot peening using a shot material composed of cast steel particles S230 having an average particle size of 500 to 800 μm, using an impeller-type device under conditions including an arc height of 0.15 mmA.

Subsequently, the surface that had undergone this first shot peening was subjected to second shot peening using a shot material composed of alumina/silica ceramic particles having an average particle size of not more than 50 μm, under conditions including a spray pressure of 0.4 MPa and a spray time of 30 seconds. The arc height for this treatment was 0.08 mmN.

A dynamic microparticle shot apparatus (PNEUMA BLASTER, model number: P-SGF-4ATCM-401, manufactured by Fuji Manufacturing Co., Ltd.) was used as the shot peening apparatus in both the first shot peening and the second shot peening.

Following the second shot peening, the concentration distribution for the residual iron fraction at the treated surface of the test specimen was measured using an EPMA (Electronic Probe MicroAnalyzer). The results are shown in the graph of FIG. 1. In this graph, the horizontal axis represents the iron fraction detection intensity Lv at a point on the shot peened surface, and the vertical axis shows the adhesion area of the iron fraction (the residual iron fraction quantity) expressed as a percentage (this description also applies to FIG. 6).

The values obtained using the EPMA analysis method disclosed in the present invention do not indicate absolute quantities, and therefore only relative evaluations of the residual iron fraction quantity are possible (this also applies to the examples and comparative examples described below).

Furthermore, in the analysis image obtained by image processing of the iron fraction concentration distribution obtained by EPMA for the test specimen of Example 1, almost no residual iron fraction was detected.

Figure 2:
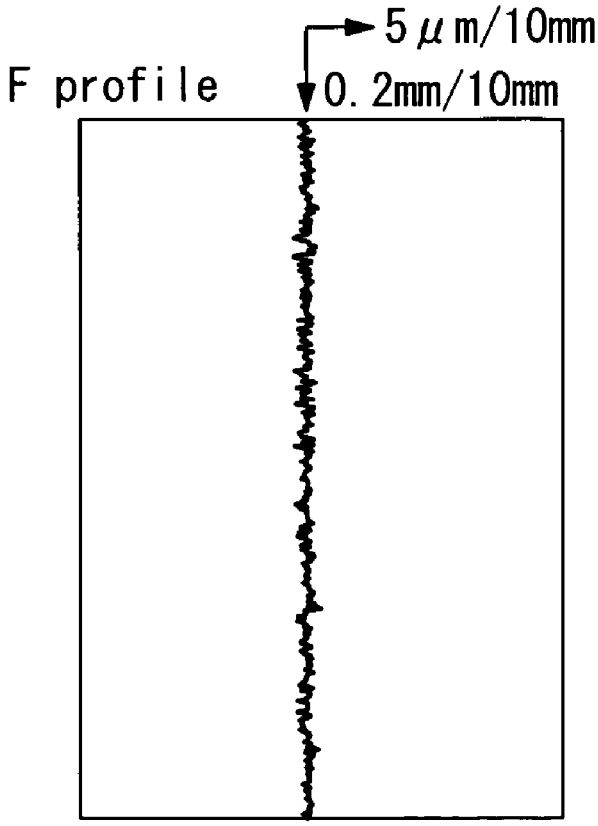
[FIG. 2] A diagram showing the surface profile of an aluminum alloy material prior to surface treatment.
Figure 4:
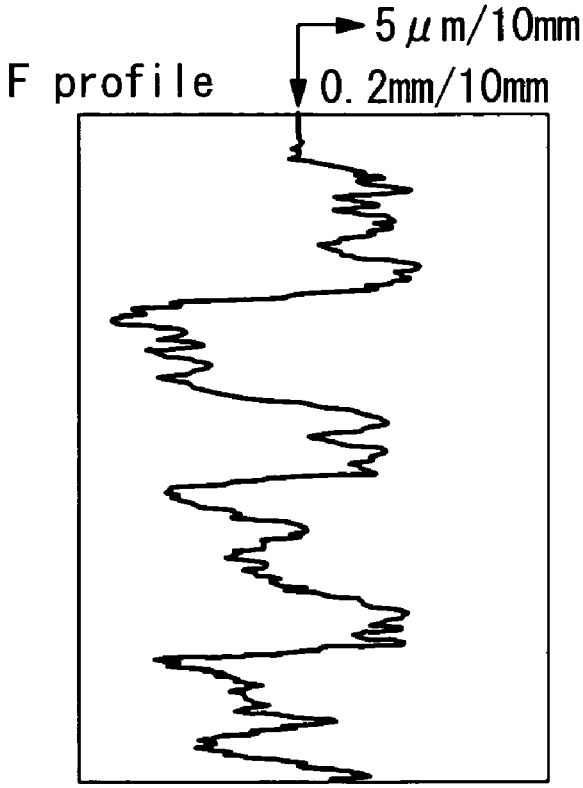
[FIG. 4] A diagram showing the surface profile of an aluminum alloy material following a surface treatment of Example 1.

Furthermore, visual inspection of the surface profile of the treated surface following the second shot peening revealed no roughness. The results of measuring the surface profiles for the aluminum alloy material before and after shot peening in Example 1 are shown in FIG. 2 and FIG. 4 respectively. Furthermore, the results of measuring the surface roughness (Ra) of the aluminum alloy material before and after shot peening in Example 1 are shown in Table 1, together with the results for the other example and comparative examples. As shown in Table 1, very favorable results were obtained, with the second shot peening actually reducing the roughness.

Comparative Example 1

The second shot peening in Example 1 was not performed, and following the first shot peening, the concentration distribution for the residual iron fraction at the treated surface of the test specimen was measured using an EPMA. The results are shown in the graph of FIG. 1.

From the results shown in FIG. 1 it is evident that whereas almost no iron fraction remained on the treated surface following the treatment of Example 1, a residual iron fraction existed on the treated surface following the treatment of Comparative Example 1.

Furthermore, in the analysis image obtained by image processing of the iron fraction concentration distribution obtained by EPMA for the test specimen of Comparative Example 1, regions having a high residual iron fraction concentration were detected.

Figure 3:
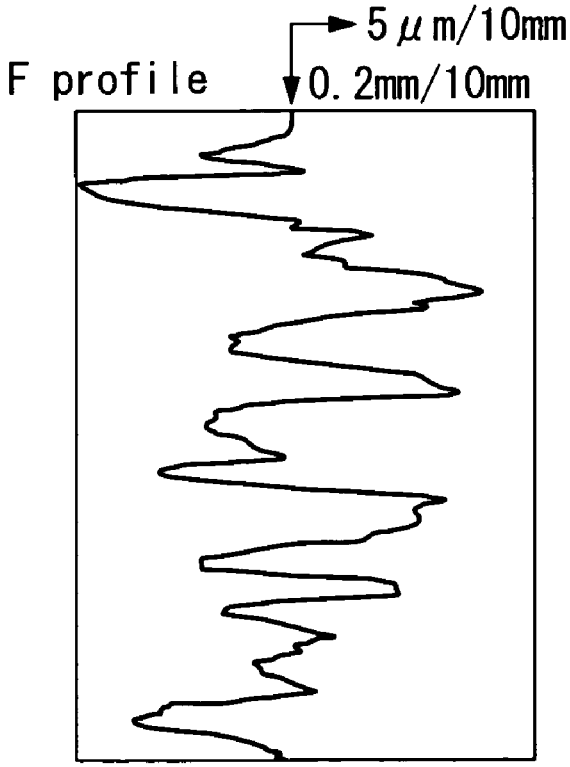
[FIG. 3] A diagram showing the surface profile of an aluminum alloy material following a surface treatment of Comparative Example 1.

The result of measuring the surface profile for the aluminum alloy material after shot peening in Comparative Example 1 is shown in FIG. 3. Furthermore, the result of measuring the surface roughness (Ra) of the aluminum alloy material after shot peening in Comparative Example 1 is shown in Table 1, together with the results for the other examples and comparative examples.

Comparative Example 2

Following the first shot peening in Comparative Example 1, an iron fraction removal treatment was performed by immersing the test specimen for 30 minutes in a mixed solution of nitric acid, anhydrous chromic acid and hydrofluoric acid.

In the analysis image obtained by image processing of the iron fraction concentration distribution obtained by EPMA for the test specimen of Comparative Example 2, regions having a residual iron fraction concentration were detected.

Figure 5:
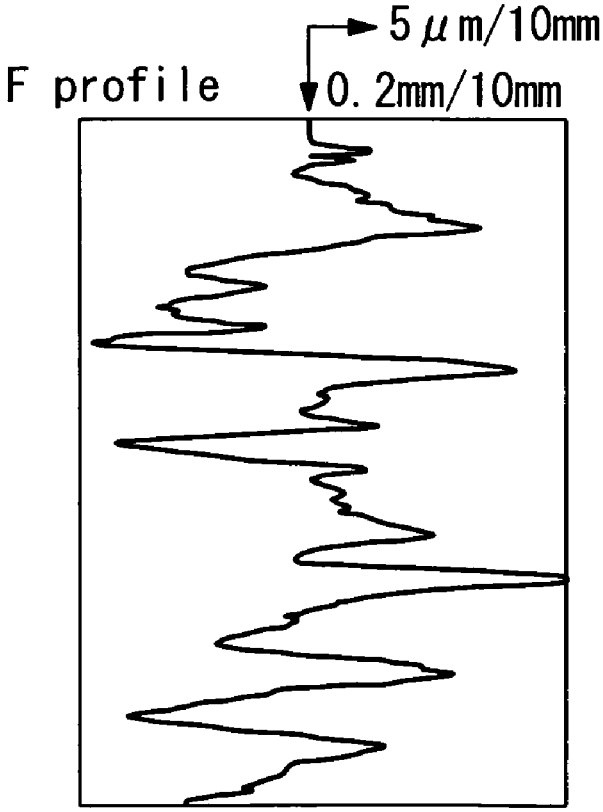
[FIG. 5] A diagram showing the surface profile of an aluminum alloy material following a surface treatment of Comparative Example 2.

Furthermore, visual inspection of the surface profile of the treated surface following the iron fraction removal treatment revealed that the aluminum alloy of the substrate had partially dissolved, generating roughness. The result of measuring the surface profile for the aluminum alloy material after shot peening in Comparative Example 2 is shown in FIG. 5. Furthermore, the result of measuring the surface roughness (Ra) of the aluminum alloy material after shot peening in Comparative Example 2 is shown in Table 1, together with the results for the other examples and comparative examples.

Example 2

A sheet of a titanium alloy material (Ti-6Al-4V (an annealed material), dimensions: 19 mm×76 mm×2.4 mm) was used as the metallic material for a test specimen. One surface of this specimen was subjected to first shot peening using a shot material composed of cast steel particles having an average particle size of 120 to 300 μm, using an impeller-type device under conditions including an arc height of 0.18 mmN.

Figure 6:
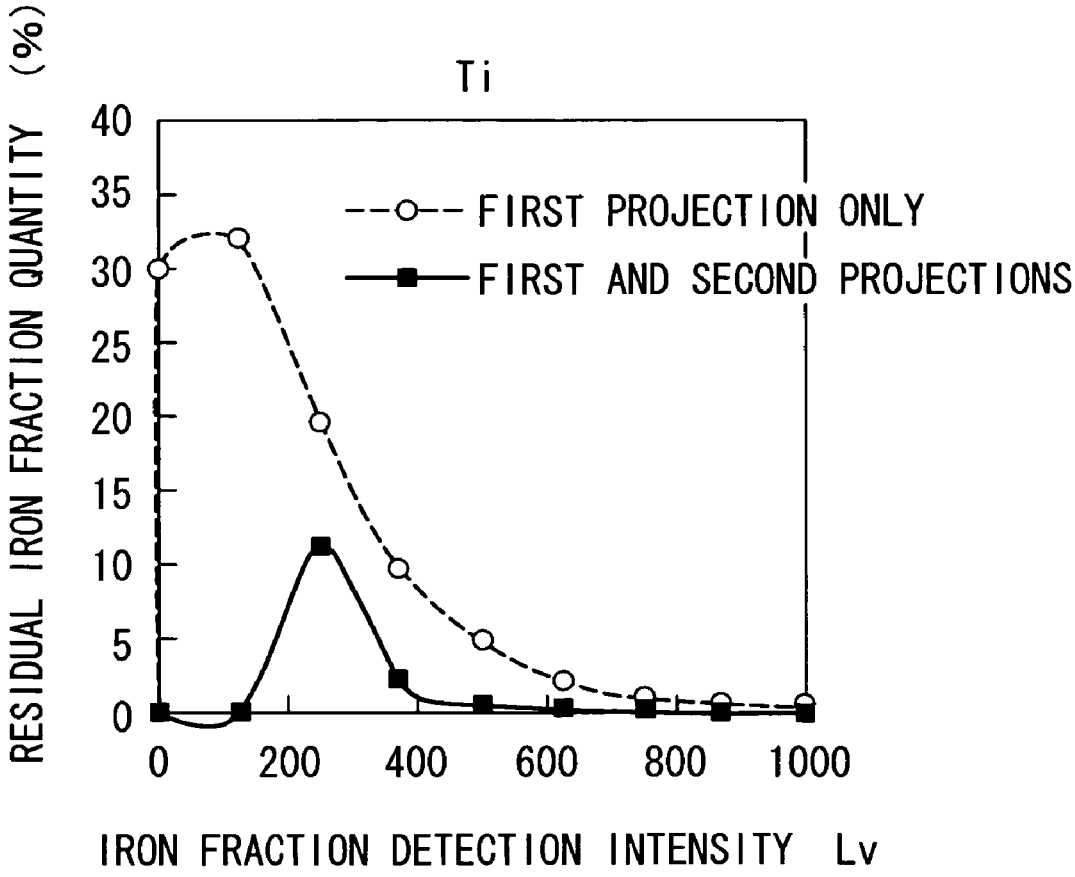
[FIG. 6] A diagram showing a concentration distribution for the residual iron fraction at the treated surface of a test specimen composed of a titanium alloy material following shot peening the specimen.

Following the second shot peening, the concentration distribution for the residual iron fraction at the treated surface of the test specimen was measured using an EPMA. The results are shown in the graph of FIG. 6. Although a slight residual iron fraction is noticeable in FIG. 6, by optimizing the conditions for the second shot peening, the iron fraction can be completely removed.

Furthermore, in the analysis image obtained by image processing of the iron fraction concentration distribution obtained by EPMA for the test specimen of Example 2, almost no residual iron fraction was detected.

Figure 7:
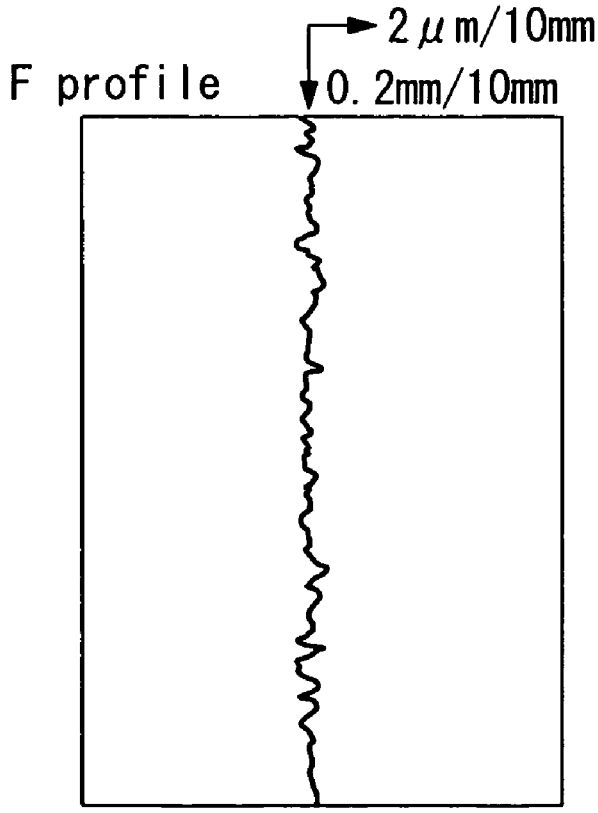
[FIG. 7] A diagram showing the surface profile of a titanium alloy material prior to surface treatment.
Figure 9:
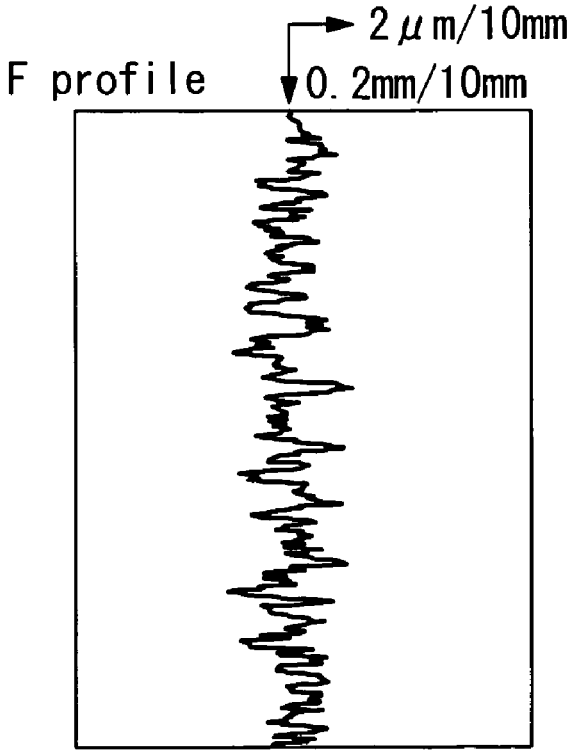
[FIG. 9] A diagram showing the surface profile of a titanium alloy material following a surface treatment of Example 2.

Furthermore, visual inspection of the surface profile of the treated surface following the second shot peening revealed no roughness. The results of measuring the surface profiles for the titanium alloy material before and after shot peening in Example 2 are shown in FIG. 7 and FIG. 9 respectively. Furthermore, the results of measuring the surface roughness (Ra) of the titanium alloy material before and after shot peening in Example 2 are shown in Table 1, together with the results for the other example and comparative examples. As shown in Table 1, very favorable results were obtained, with the second shot peening actually reducing the roughness.

Comparative Example 3

The second shot peening in Example 2 was not performed, and following the first shot peening, the concentration distribution for the residual iron fraction at the treated surface of the test specimen was measured using an EPMA. The results are shown in the graph of FIG. 6.

From the results shown in FIG. 6 it is evident that whereas almost no iron fraction remained on the treated surface following the treatments of Example 2, a residual iron fraction existed on the treated surface following the treatment of Comparative Example 3.

Furthermore, in the analysis image obtained by image processing of the iron fraction concentration distribution obtained by EPMA for the test specimen of Comparative Example 3, regions having a high residual iron fraction concentration were detected.

Figure 8:
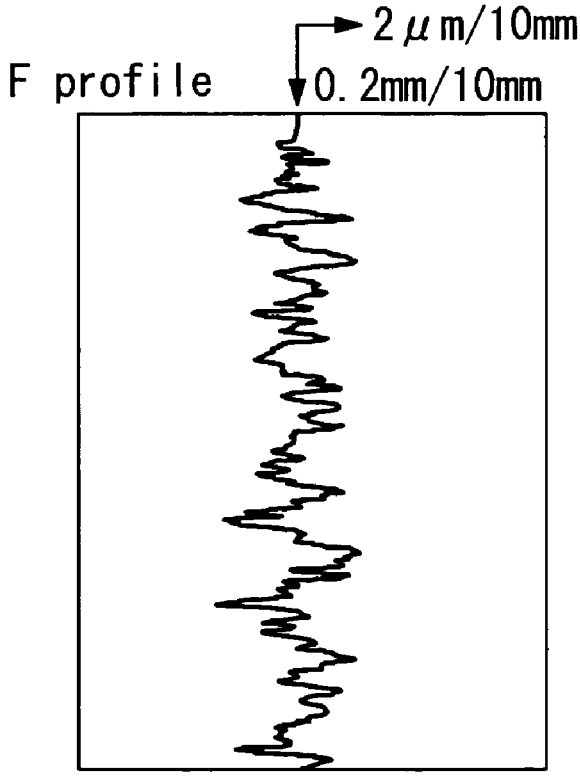
[FIG. 8] A diagram showing the surface profile of a titanium alloy material following a surface treatment of Comparative Example 3.

The result of measuring the surface profile for the titanium alloy material after shot peening in Comparative Example 3 is shown in FIG. 8. Furthermore, the result of measuring the surface roughness (Ra) of the titanium alloy material after shot peening in Comparative Example 3 is shown in Table 1, together with the results for the other examples and comparative examples.

Comparative Example 4

Following the first shot peening in Comparative Example 3, an iron fraction removal treatment was performed by immersing the test specimen for 30 minutes in an aqueous solution of nitric acid.

In the analysis image obtained by image processing of the iron fraction concentration distribution obtained by EPMA for the test specimen of Comparative Example 4, regions having a residual iron fraction concentration were detected.

Figure 10:
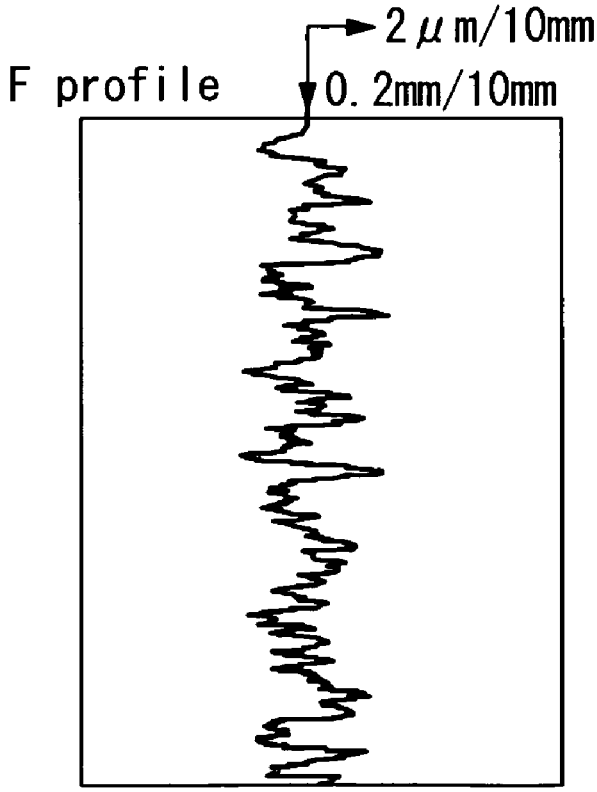
[FIG. 10] A diagram showing the surface profile of a titanium alloy material following a surface treatment of Comparative Example 4.

Furthermore, visual inspection of the surface profile of the treated surface following the iron fraction removal treatment revealed that the titanium alloy of the substrate had partially dissolved, generating roughness. The result of measuring the surface profile for the titanium alloy material after shot peening in Comparative Example 4 is shown in FIG. 10. Furthermore, the result of measuring the surface roughness (Ra) of the titanium alloy material after shot peening in Comparative Example 4 is shown in Table 1, together with the results for the other examples and comparative examples.

TABLE 1

Change in Surface Roughness upon Shot Peening Ra (μm)

| Test specimen | Prior to shot | Cast steel shot | Cast steel shot + microparticle shot | Cast steel shot + wet iron fraction removal |
|---|---|---|---|---|
| Aluminum alloy | 0.2 | 5.3 (Comparative example 1) | 4.8 (Example 1) | 5.2 (Comparative example 2) |
| Titanium alloy | 0.12 | 0.60 (Comparative example 3) | 0.55 (Example 2) | 0.66 (Comparative example 4) |

The invention claimed is:

1. A process for producing a metallic component, comprising:

projecting first particles comprising iron as a main component and having an average particle size of not less than 0.1 mm and not more than 5 mm onto a surface of a metallic material comprising a lightweight alloy; and following completion of said projecting of the first particles, projecting second particles comprising essentially no iron and having an average particle size of not more than 200 μm onto the surface of the metallic material, wherein in said projecting of the first particles, the first particles are projected at an intensity not less than 0.10 mmA and not more than 0.30 mmA, expressed in terms of an arc height value determined using an Almen gauge system, and at a coverage not less than 100% and not more than 1,000%, in said projecting of the second particles, the second particles are projected at a coverage not less than 100% and not more than 1,000%, a spray speed of the first particles and a spray speed of the second particles are regulated by a spray pressure of a compressed air stream, and the spray pressure in said projecting of the first particles is not less than 0.1 MPa and not more than 1 MPa.

2. A process for producing a metallic component according to claim 1, wherein the spray pressure in said projecting of the first particles is not less than 0.2 MPa and not more than 0.5 MPa.

3. A structural member having a metallic component produced using the process according to claim 1.

* * * * *